US011427975B2

(12) United States Patent
Wang et al.

(10) Patent No.: US 11,427,975 B2
(45) Date of Patent: Aug. 30, 2022

(54) PRECAST SEGMENTAL PIER REINFORCED WITH BOTH CONVENTIONAL STEEL BARS AND HIGH-STRENGTH STEEL BARS

(71) Applicant: HENGQIN GONGE TECHNOLOGY CO., LTD., Guangdong Province (CN)

(72) Inventors: Zhenyu Wang, Guangdong Province (CN); Zhongkui Cai, Guangdong Province (CN)

(73) Assignee: HENGQIN GONGE TECHNOLOGY CO., LTD., Guangdong Province (CN)

( * ) Notice: Subject to any disclaimer, the term of this patent is extended or adjusted under 35 U.S.C. 154(b) by 141 days.

(21) Appl. No.: 16/967,287

(22) PCT Filed: Feb. 1, 2019

(86) PCT No.: PCT/CN2019/074423

§ 371 (c)(1),
(2) Date: Aug. 4, 2020

(87) PCT Pub. No.: WO2019/149270

PCT Pub. Date: Aug. 8, 2019

(65) Prior Publication Data

US 2021/0032819 A1 Feb. 4, 2021

(30) Foreign Application Priority Data

Feb. 5, 2018 (CN) ..... 201820196039.9

(51) Int. Cl.
*E01D 19/02* (2006.01)
*E01D 21/00* (2006.01)
(Continued)

(52) U.S. Cl.
CPC ..... *E01D 19/02* (2013.01); *E01D 21/00* (2013.01); *E01D 2101/22* (2013.01); *E01D 2101/30* (2013.01)

(58) Field of Classification Search
CPC ..... E01D 19/02; E01D 21/00; E01D 2101/22; E01D 2101/30
(Continued)

(56) References Cited

U.S. PATENT DOCUMENTS 3,685,934 A * 8/1972 Huber ..... E04G 15/04 249/43
4,042,308 A * 8/1977 Freedman ..... E01B 25/10 404/1
(Continued)

FOREIGN PATENT DOCUMENTS

CN 101831875 A 9/2010
CN 102304892 A 1/2012
(Continued)

OTHER PUBLICATIONS

International Search Report for PCT/CN2019/074423 dated Apr. 29, 2019.

*Primary Examiner* — Raymond W Addie
(74) *Attorney, Agent, or Firm* — The PL Law Group, PLLC

(57) ABSTRACT

A precast segmental pier reinforced with both conventional steel bars and high-strength steel bars according to one or more embodiments of the present invention includes a footing, a segmental pier, longitudinal bars and unbonded post-tensioned tendons, characterized in that: the segmental pier is comprised of one or more precast segments, the longitudinal bars are comprised of both the conventional steel bar and the high-strength steel bar, connecting the footing and the segmental pier together with unbonded post-tensioned tendons to form an entire pier.

14 Claims, 5 Drawing Sheets

(51) Int. Cl.
*E01D 101/22* (2006.01)
*E01D 101/30* (2006.01)

(58) Field of Classification Search
USPC ..... 14/75, 77.1, 78
See application file for complete search history.

(56) References Cited

U.S. PATENT DOCUMENTS 5,228,807 A * 7/1993 Willcox, Jr. ..... E02D 5/60 405/257
5,509,759 A * 4/1996 Keesling ..... E02D 5/58 425/432
5,909,984 A * 6/1999 Matthews ..... E02D 5/30 405/257
6,123,485 A * 9/2000 Mirmiran ..... E04C 3/29 405/232
6,295,782 B1 * 10/2001 Fyfe ..... E04C 5/07 52/359
6,832,454 B1 * 12/2004 Iyer ..... E04G 5/08 52/223.4
6,938,392 B2 * 9/2005 Fouad ..... E04H 12/12 52/223.4
7,445,405 B2 * 11/2008 Yurkevich ..... E02D 5/48 405/257
7,546,656 B2 * 6/2009 Kim ..... E01D 2/00 14/77.3
8,341,788 B2 * 1/2013 Kim ..... E01D 19/00 14/77.3
8,375,678 B1 * 2/2013 Ferrer ..... E04C 5/0604 52/649.3
8,539,629 B2 * 9/2013 Han ..... E01D 2/00 52/223.1
8,578,537 B2 * 11/2013 Ley ..... E04C 3/20 52/252
9,267,286 B2 * 2/2016 Kim ..... E04C 5/0604
9,637,923 B2 * 5/2017 Radhouane ..... E04C 3/293

FOREIGN PATENT DOCUMENTS

CN 102409606 A 4/2012
CN 103074847 A 5/2013
CN 103374881 A 10/2013
CN 203603039 U 5/2014
CN 105714673 A 6/2016
CN 205576723 U 9/2016
CN 108316130 A 7/2018
CN 208280001 U 12/2018
JP 2005-097946 A 4/2005

* cited by examiner

PRECAST SEGMENTAL PIER REINFORCED WITH BOTH CONVENTIONAL STEEL BARS AND HIGH-STRENGTH STEEL BARS

CROSS REFERENCE TO RELATED APPLICATIONS AND CLAIM OF PRIORITY

This application claims benefit under 35 U.S.C. 119(e), 120, 121, or 365(c), and is a National Stage entry from International Application No. PCT/CN2019/074423 filed Feb. 1, 2019, which claims priority to the benefit of Chinese Patent Application No. 201820196039.9 tiled in the Chinese Intellectual Property Office on Feb. 5, 2018, the entire contents of which are incorporated herein by reference.

TECHNICAL FIELD

The invention relates to a precast segmental pier, in particular to a precast segmental pier reinforced with both conventional steel bars and high-strength steel bars.

BACKGROUND OF THE INVENTION

The bridge collapses resulting from natural disasters such as earthquakes and wars need to be rapidly rebuilt by adopting accelerated bridge construction technology. The precast segmental pier becomes one of the effective approaches, and the wide application potential of the precast segmental pier benefits from the following main advantages: (1) most of the components are industrially manufactured and mechanically assembled, so that the construction efficiency is outstanding; (2) the construction period is short and is less influenced by seasons and weather; (3) the durability of the pier is high and the maintenance cost in lifespan is reduced because of better manufacturing and maintenance conditions of the precast components; (4) it reduces environmental impact around the bridge construction site.

So far, the rapid construction of the bridge superstructure by adopting the precast segmental piers is well-established; by contrast, the engineering application of the precast segmental pier is very limited, and the main reason is that the research, development and application of the seismic resistance of the novel precast segmental pier are still insufficient. China is on the junction of the Pacific seismic zone around the Pacific and the Mediterranean-Himalayan seismic zone, and is one of the most serious countries of the world in seismic disasters. Most of the researches and inventions of the existing precast segmental pier mainly aim at improving the construction convenience of the pier or reducing the damage of the pier after the earthquake, however, the maximum displacement response of the pier under the seismic excitation and the residual drift after the earthquake can hardly be controlled effectively.

The existing research shows that the maximum displacement response and the discreteness of the pier during earthquake can be effectively reduced by improving the post-yield stiffness of the pier, and meanwhile, the self-centering capability of the pier is obviously improved, and the post-earthquake functionality of the bridge structure is ensured. The prefabricated assembling technology is utilized to the efficient and green construction of the pier, and the post-yield stiffness of the pier is obviously improved, the seismic performance and self-centering capacity of the pier are obviously improved as well, so that the prefabricated assembling technology is of outstanding practical significance to the large-scale construction of traffic infrastructures in China. However, a well-established approach of effectively improving the post-yielding stiffness of the precast segmental pier is not available.

SUMMARY

In order to solve the aforementioned problems, the invention provides a precast segmental pier reinforced with both conventional steel bars and high-strength steel bars and a construction method thereof, and solves the problem that the maximum displacement reaction during earthquake and the residual drift after earthquake are difficult to simultaneously reduce in the prior art of the precast segmental pier. The standard value of the yield strength of the conventional steel bar is 400 to 500 MPa, the standard value of the yield strength of the high-strength steel bar is 785 to 1200 MPa, and the conventional steel bar and the high-strength steel bar have the same elastic modulus. Therefore, when the precast segmental pier reinforced with both conventional steel bars and high-strength steel bars provided by the invention suffers from earthquake disasters, the conventional steel bars arranged in the pier yield first and dissipate the energy input into the bridge structure by the ground motion in the way of elastic-plastic deformation, so that the dynamic reactions such as bridge displacement, acceleration are favorably reduced; after the conventional steel bars yield, the high-strength steel bars can still keep elastic, when the earthquake intensity is continuously increased, displacement and dynamic reaction of pier is increased, meanwhile, the tensile stress level of the high-strength steel bars is continuously increased, and the horizontal bearing capacity of the pier is increased, so that the post-yield stiffness is favorably improved. By adopting the precast segmental pier reinforced with both conventional steel bars and high-strength steel bars, the post-yield stiffness is improved, the discreteness of the elastic-plastic maximum dynamic response of the pier under strong earthquake is reduced, and the performance-based seismic design of the precast segmental pier is facilitated; the improvement of post-yield stiffness of the precast segmental pier can also effectively improve the self-centering capacity of the pier, obviously reduce the residual drift of the pier and improve the functionality and the repairability of the bridge structure after the earthquake; In addition, the construction method of the precast segmental pier is simple, convenient and feasible, and ensures efficient and green construction of the pier.

The invention provides a precast segmental pier reinforced with both conventional steel bars and high-strength steel bars, comprising a footing 1, a segmental pier 2, longitudinal bars 6 and unbonded post-tensioned tendons 7, characterized in that: the segmental pier 2 is composed of one or more precast segments 4, the longitudinal bars 6 are composed of both the conventional steel bar 10 and the high-strength steel bar 11, connecting the footing 1 and the segmental pier 2 together with unbonded post-tensioned tendons 7 to form a entire pier.

The geometric dimension, the reinforcement and the materials of each precast segment 4 can be the same, so that the assembling is easier, and the construction efficiency is improved; and can also be different so as to reduce the prefabrication cost of the pier. The upper surface and the lower surface of each precast segment 4 can be flat, so that the shearing force generated under the earthquake is effectively transmitted between the upper precast segment and the lower precast segment mainly by a friction mechanism; In addition, according to the requirement of seismic design, the upper surface and the lower surface of the precast segment 4 can be provided with one or more shear keys, so that the upper precast segment and the lower precast segment are interlocked, and the shear bearing capacity at the segment joints can be effectively improved.

The longitudinal bars 6 are composed of conventional steel bars 10 and high-strength steel bars 11, and the ratio of the reinforcement ratio of the conventional steel bar 10 to the reinforcement ratio of the high-strength steel bars 11 is 0.5 to 2.0. As shown in FIG. 1, two kinds of longitudinal bars are arranged at intervals.

Conventional steel bars can be HRB400, HRB500, HRBF400, HRBF500, HRB400E, HRB500E, HRBF400E or HRBF 500E. The high-strength steel bars can be PSB785, PSB830, PSB930, PSB1080 or PSB1200. Corrugated ducts 5 are reserved in the footing 1 and each precast segment 4. The corrugated ducts 5 is realized by embedding a metal corrugated pipe in advance, the corrugated pipe is a circular metal corrugated pipe 9, the diameter of metal corrugated pipe 9 is (2~3) d, which d is the diameter of the longitudinal bar, and the corrugated pipe meets the requirements of the specification of metal corrugated pipes for prestressed concrete (JG 225-2007). The embedded part of a metal corrugated pipe in the footing 1 is no less than 36 d, which d is the diameter of longitudinal bar, Additionally, the lower end of the high-strength steel bar is used together with an anchor matched with it so as to enhance the anchorage performance.

The lower end of the unbonded post-tensioned tendons 7 are anchored in the footing 1, and the tendons sequentially pass through the ducts for post-tensioned tendons 8 with smooth inner wall reserved in each precast segment 4 when the pier is assembled, and the upper unbonded post-tensioned tendons 7 are anchored in the recess for the anchor of post-tensioned tendons 3 after tensioning; The unbonded post-tensioned tendons 7 can be steel strands, deformed steel bars or FRP bars.

The present invention has the following advantageous effects compared with the prior art:

The longitudinal bars are composed of a conventional steel bar with a lower yielding point and a high-strength steel bar with a higher yielding point, and can obviously improve the post-yield stiffness of the precast segmental pier, thereby reducing the maximum displacement response and the discreteness of the precast segmental pier wider an earthquake excitation, effectively improving the self-centering capability of the precast segmental pier, reducing the residual displacement and improving the serviceability of the bridge structure after earthquake disasters.

By adjusting the proportion of the conventional steel bars and the high-strength steel bars, the yield load capacity, the post-yield stillness, the peak load capacity and the ultimate drift ratio of the precast segmental pier can be effectively controlled, and therefore the design of the precast segmental pier at multiple performance levels is achieved.

The precast segmental pier provided by the invention has outstanding hysteretic energy dissipation capability and can effectively absorb and dissipate energy input to a bridge structure during earthquake, so that an energy dissipation damper or an isolation bearing does not need to be additionally arranged, and the bridge construction cost is reduced.

The longitudinal bars of the precast segmental pier are constrained by the high-strength grouting material, and the outside of the high-strength grouting material is also confined by the metal corrugated pipe and the steel hoops, so that the longitudinal bars generally do not suffer from buckling failure under compression during an earthquake; on the other hand, the high-strength grouting material restrained by the metal corrugated pipe can resist compression together with the concrete, so that the compression stress level and the degree of damage of the concrete can be lower. Therefore, the precast segmental pier provided by the invention has more repairability after earthquake, and helps rapidly recover the bridge traffic network in the earthquake disaster areas.

The precast segmental pier provided by the invention is simple in assembling process, and the requirement on operation precision during assembling is not high; and large-scale equipment is not needed during transportation and assembling, hence, the construction is flexible and efficient, and the bridge can be rapidly constructed.

DETAILED DESCRIPTION

Figure 1:
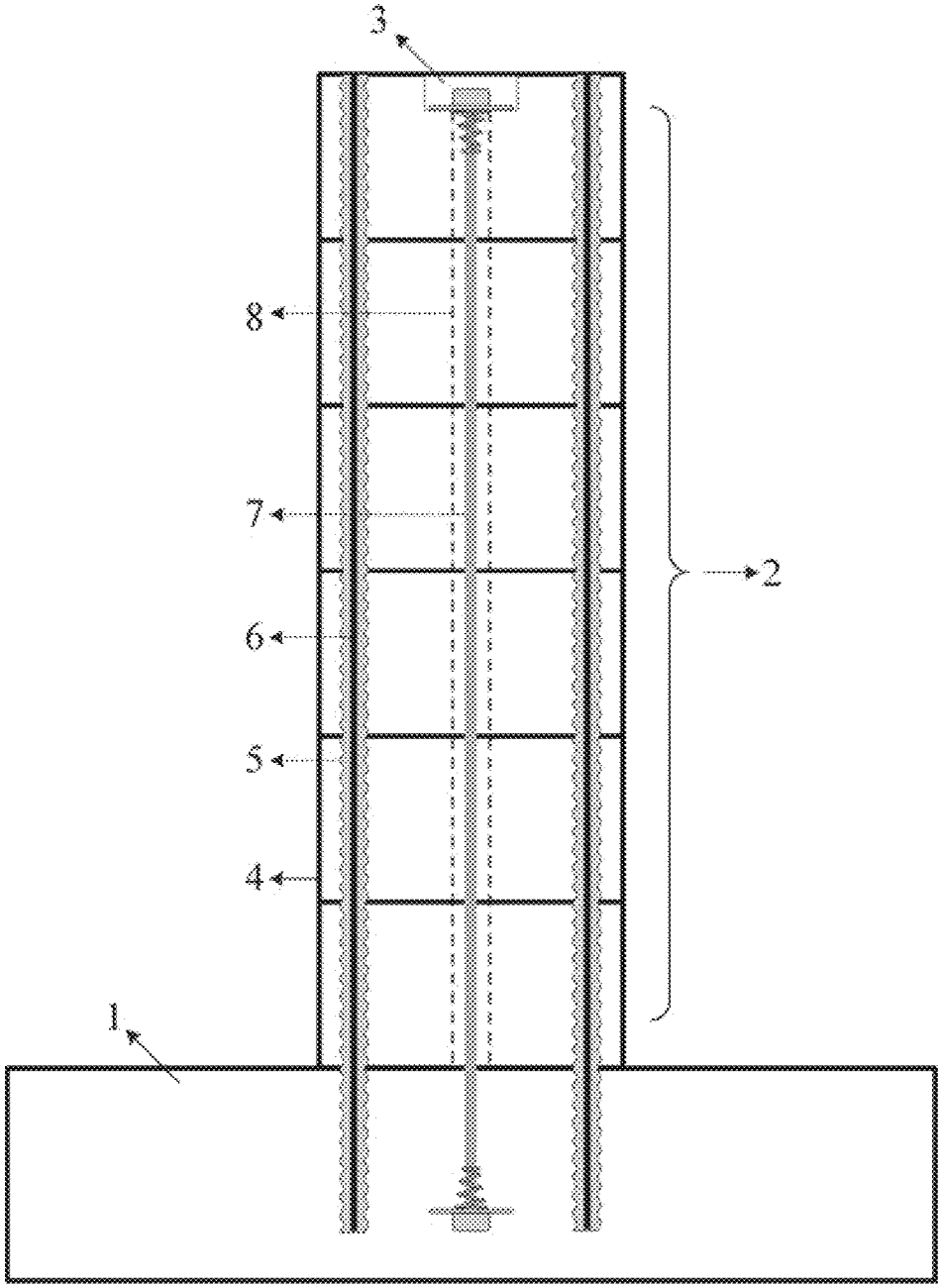
FIG. 1 is a schematic longitudinal cross-sectional view of a precast segmental pier according to embodiment 1.
Figure 2:
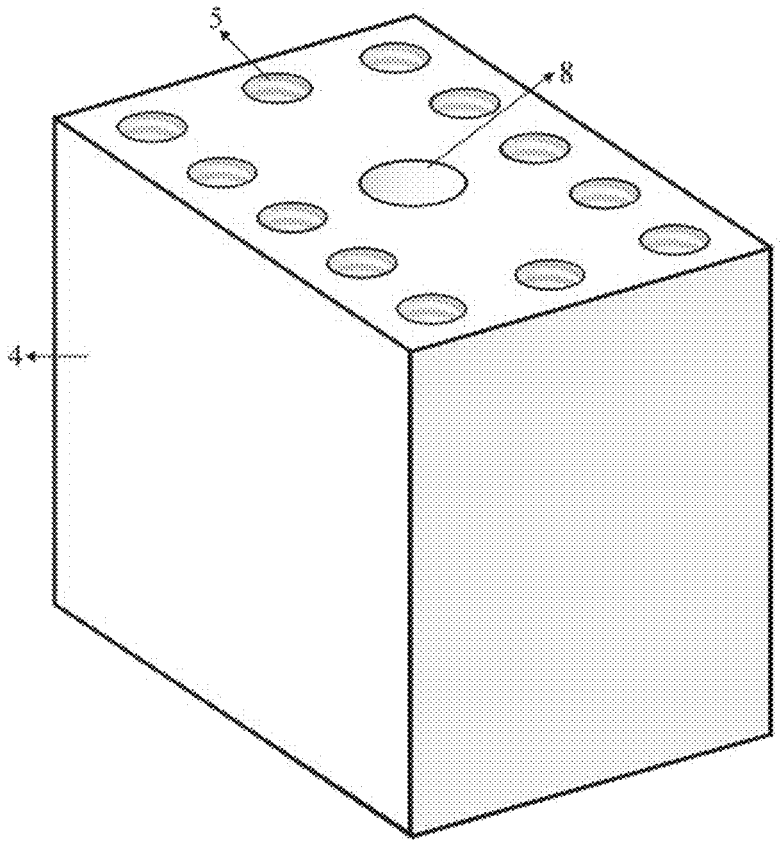
FIG. 2 is a schematic 3D view of a single precast segment.
Figure 3:
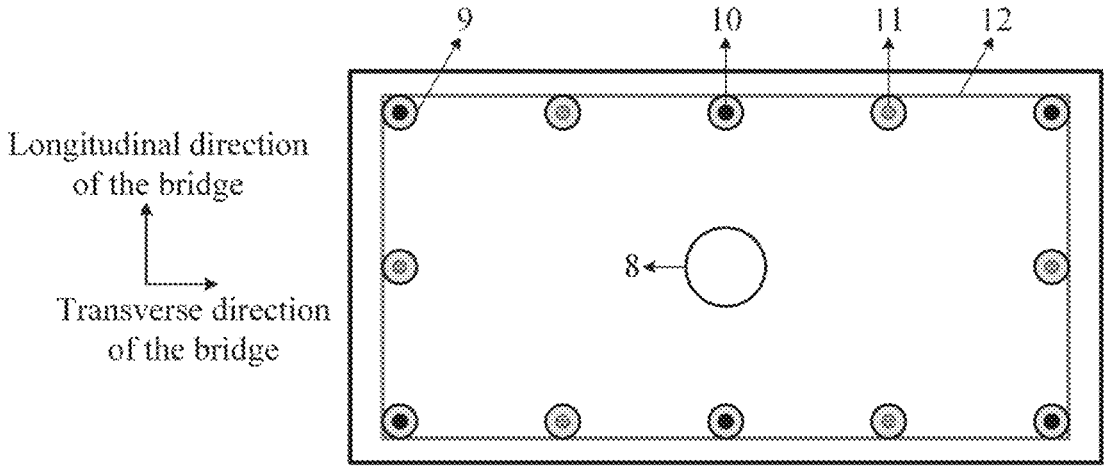
FIG. 3 is a schematic cross-sectional view of a precast segmental pier.
Figure 4:
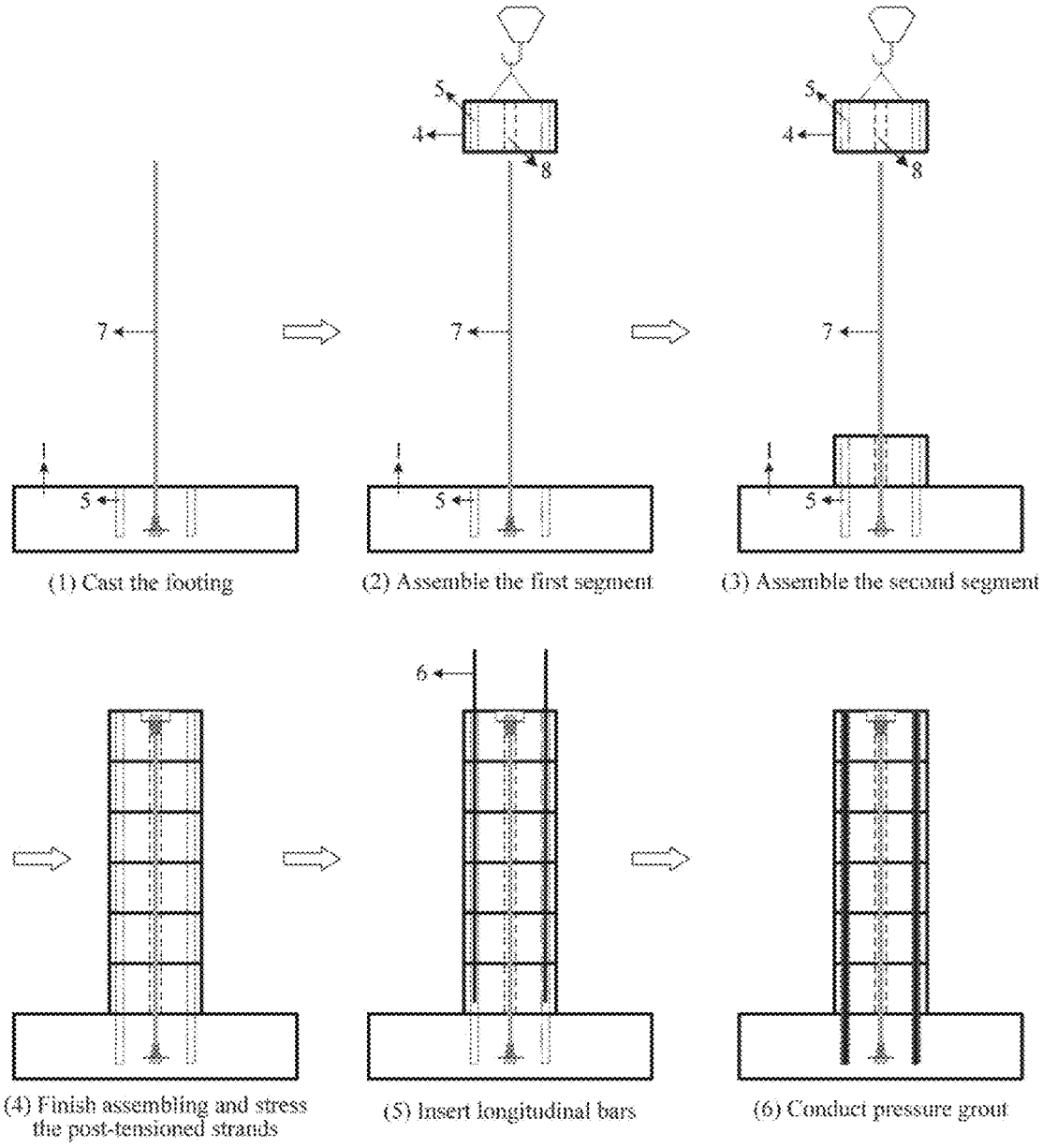
FIG. 4 is a schematic of the construction process of the precast segmental pier in the present invention.

The invention is described in further detail below with reference to the following figures and embodiments:

1. Embodiment 1, as shown in FIG. 1, the invention provides a precast segmental pier reinforced with both conventional steel bars 10 and high-strength steel bars 11, comprising a footing 1, a segmental pier 2, longitudinal bars 6 and unbonded post-tensioned tendons 7. The segmental pier 2 is composed of one or more precast segments 4, and the footing 1 and the segmental pier 2 are connected together by unbonded post-tensioned tendons 7 to form a entire pier. Each precast segment 4 has a rectangular cross-section with the same cross-sectional dimension and the same segment height. The height of the segments is 1.5 to 4 times of the size of the long edge of the section, so that the plastic hinge of the precast segmental pier can be fully developed to ensure the energy dissipation capacity in seismic design, and the volume and the weight of a single precast segment 4 are small for assembling conveniently. As shown in FIG. 2, each precast segment 4 is provided with the same number of corrugated ducts 5 at the same cross-sectional position. Therefore, the corrugated ducts 5 and the ducts for post-tensioned tendons 8 can be achieved after assembly. After the precast segments 4 are assembled and the unbonded post-tensioned tendons 7 are tensioned, the longitudinal bars 6 are placed into the corrugated ducts 5. If the length of the single longitudinal bar 6 is smaller than the height of the segmental pier 2, the longitudinal bar 6 is extended in the approach of mechanical connection, welding or binding connection. The construction method of the precast segmental pier reinforced with both conventional steel bars and high-strength steel bars in the embodiment 1 is shown in FIG. 4: firstly, pouring the footing 1, and reserving the corrugated ducts 5 during pouring so as to insert the longitudinal bars 6 into the footing 1 for anchorage; Then, assembling the lower precast segments 4, and sequentially assembling the other precast segments 4 to enable the unbonded post-tensioned tendons 7 to through the ducts for post-tensioned tendons 8 of the precast segments 4; Tensioning the unbonded post-tensioned tendons 7 after the assembly is completed; And then, placing the longitudinal bars 6 into the the corrugated ducts 5, finally, pressure grouting is carried out in the corrugated ducts 5, and grouting quality is ensured. The longitudinal bars 6 are restrained by the surrounding grouting material, the metal corrugated pipes 9 and the steel hoops 12, so that the longitudinal bars 6 generally do not suffer from buckling failure under compression during an earthquake. The high-strength growing material confined by the metal corrugated pipe 9 can resist compression together with the concrete, so that the compression stress level and the degree of damage of the concrete can be lower. Therefore, the precast segmental pier has better durability and post-seismic performance than the cast-in-situ pier, and ensures the rapid recovery of the bridge traffic network in the earthquake disaster areas.

Figure 5:
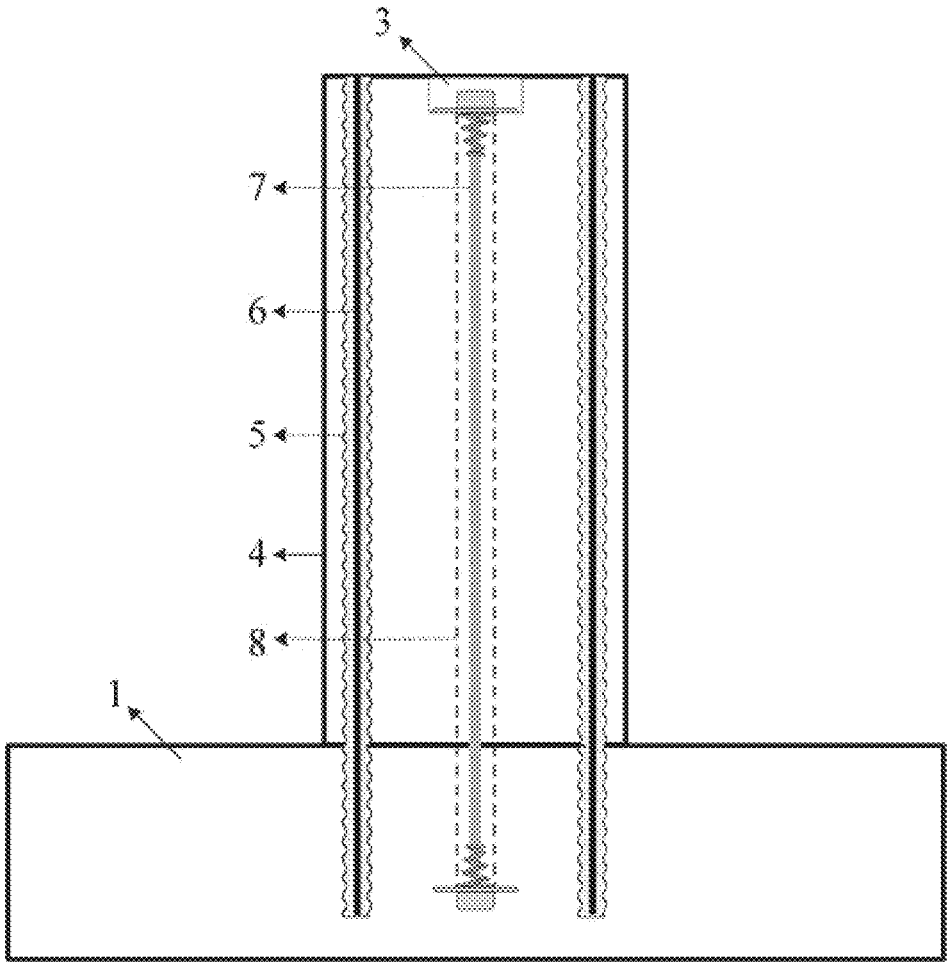
FIG. 5 is a schematic longitudinal cross-sectional view of a precast segmental pier according to embodiment 2.

2. Embodiment 2, as shown in FIG. 5, the embodiment 2 is different from the the embodiment 1 in that the segmental pier 2 of the precast segmental pier reinforced with both conventional steel bars and high-strength steel bars has only one precast segment 4. When the slenderness ratio of the segmental pier 2 is no more than 6, the segmental pier 2 can be a single precast segment 4, so that the assembling efficiency can be improved. Moreover, when the slenderness ratio of the segmental pier 2 is no more than 6, the size and the weight of the segmental pier 2 are not too large to be transported and assembled. When the same or similar design and construction as in the embodiment 2 is adopted, it should be noted that the size and weight of the segmental pier 2 meet the related transportation regulations and do not exceed the limit of the hoisting equipment.

Figure 6:
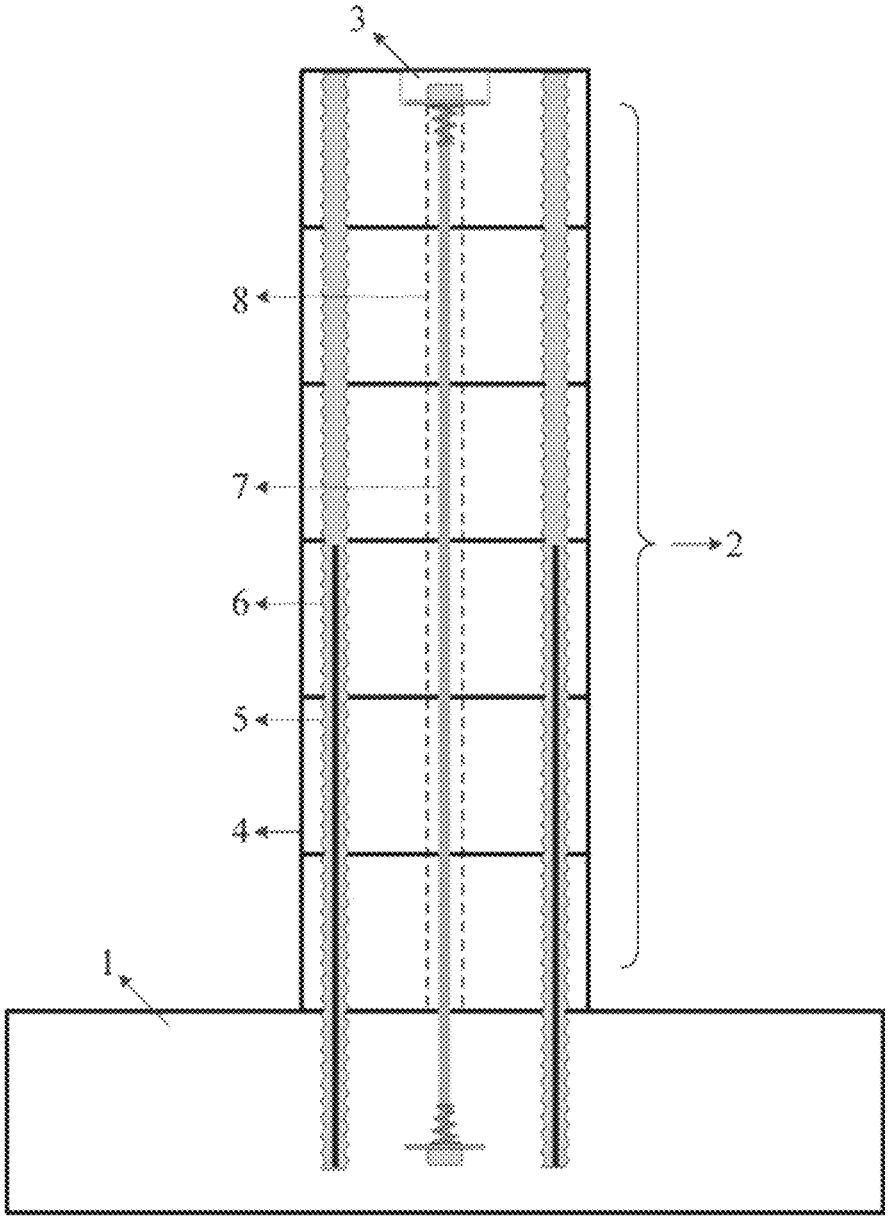
FIG. 6 is a schematic longitudinal cross-sectional view of a precast segmental pier according to embodiment 3.

3. Embodiment 3, as shown in FIG. 6, the present embodiment is different from the embodiment 1 in that conventional steel bars 10 and high-strength steel bars 11 only pass through several precast segments 4 of the lower part of the segmental pier 2, and are not arranged along the entire pier. For a cantilever pier, the bending moment of the bottom of the pier is the largest under the action of an earthquake, and the bending moment is gradually reduced from the bottom of the pier to the top of the pier. In seismic design, longitudinal bar reinforcement ratio can be gradually reduced according to bending moment distribution of pier, and finally, the longitudinal bar is cut at a certain reasonable height. The cutting of the longitudinal bar 6 is in accordance with the corresponding seismic design specification. When the height of the precast segmental pier reinforced with both with conventional steel bars and high-strength steel bars is larger, the amount of conventional steel bars 10 and high-strength steel bars 11 can be effectively reduced by this method while the seismic performance is ensured, so that the economic benefit and the construction efficiency are favorably improved.

Finally, the above embodiments are only used to illustrate the technical solution of the present invention and are not limited.

What is claimed is:

1. A precast segmental pier reinforced with first steel bars and second steel bars having higher strength than the first steel bars, comprising a footing, a segmental pier, longitudinal bars and unbonded post-tensioned tendons, characterized in that: the segmental pier is comprised of one or more precast segments, the longitudinal bars are comprised of both the first steel bars and the second steel bars, connecting the footing and the segmental pier together with unbonded post-tensioned tendons to form an entire pier, wherein the first steel bars are HRB400, HRB500, HRBF400, HRBF500, HRB400E, HRB500E, HRBF400E or HRBF 500E, and the second steel bars are PSB785, PSB830, PSB930, PSB1080 or PSB1200.

2. The precast segmental pier of claim 1, wherein the ratio of the reinforcement ratio of the first steel bar to the reinforcement ratio of the second steel bars is 0.5 to 2.0, and the longitudinal bars are arranged symmetrically and/or at intervals in the cross-section.

3. The precast segmental pier of claim 1, wherein the upper surface and the lower surface of each precast segment are flat or be provided with one or more shear keys.

4. The precast segmental pier of claim 1, wherein the lower end of the second steel bar is used together with an anchor matched with it so as to enhance the anchorage performance.

5. The precast segmental pier of claim 1, wherein the lower end of the unbonded post-tensioned tendons are anchored in the footing, and the tendons sequentially pass through the ducts for post-tensioned tendons with smooth inner wall reserved in each precast segment when the pier is assembled, and the upper unbonded post-tensioned tendons are anchored in the recess for the anchor of post-tensioned tendons after tensioning; the unbonded post-tensioned tendons are steel strands, deformed steel bars or FRP bars.

6. The precast segmental pier of claim 1, wherein corrugated ducts are reserved in the footing and each precast segment.

7. The precast segmental pier of claim 6, wherein the embedded part of the metal corrugated pipe in the footing is no less than 36d, which d is the diameter of longitudinal bar.

8. The precast segmental pier of claim 6, wherein the corrugated ducts are realized by embedding a metal corrugated pipe in advance, the corrugated pipe is a circular metal corrugated pipe, the diameter of metal corrugated pipe is d, which d is the diameter of the longitudinal bar.

9. The precast segmental pier reinforced of claim 8, wherein the embedded part of the metal corrugated pipe in the footing is no less than 36d, which d is the diameter of longitudinal bar.

10. A precast segmental pier reinforced with both first steel bars and second steel bars having higher strength than the first steel bars, comprising a footing, a segmental pier, longitudinal bars and unbonded post-tensioned tendons, characterized in that: the segmental pier is comprised of two or more precast segments, the longitudinal bars are comprised of both the first steel bars and the second steel bars, connecting the footing and the segmental pier together with unbonded post-tensioned tendons to form an entire pier; the first steel bar and the second steel bar only pass through several precast segments of the lower part of the segmental pier, and are not arranged along the entire pier, wherein the first steel bars are HRB400, HRB500, HRBF400, HRBF500, HRB400E, HRB500E, HRBF400E or HR 500E, and the second steel bars are PSB785, PSB830, PSB930, PSB1080 or PSB1200.

11. The precast segmental pier of claim 10, wherein the ratio of the reinforcement ratio of the first steel bar to the reinforcement ratio of the second steel bars is 0.5 to 2.0, and the longitudinal bars are arranged symmetrically and/or at intervals in the cross-section.

12. The precast segmental pier of claim 10, wherein the upper surface and the lower surface of each precast segment are flat or be provided with one or more shear keys.

13. The precast segmental pier of claim 10, wherein the lower end of the second steel bar is used together with an anchor matched with it so as to enhance the anchorage performance.

14. The precast segmental pier of claim 10, wherein the lower end of the unbonded post-tensioned tendons are anchored in the footing, and the tendons sequentially pass through the ducts for post-tensioned tendons with smooth inner wall reserved in each precast segment when the pier is assembled, and the upper unbonded post-tensioned tendons are anchored in the recess for the anchor of post-tensioned tendons after tensioning, and the unbonded post-tensioned tendons are steel strands, deformed steel bars or FRP bars.

* * * * *